United States Patent [19]

Shima

[11] 4,214,460

[45] Jul. 29, 1980

[54] FLAT KNITTING MACHINE

[75] Inventor: Masahiro Shima, Wakayama, Japan

[73] Assignee: Shima Idea Center Co., Ltd., Wakayama, Japan

[21] Appl. No.: 957,171

[22] Filed: Nov. 2, 1978

[30] Foreign Application Priority Data

Nov. 8, 1977 [JP] Japan ..... 52-134484

[51] Int. Cl.[2] ..... D04B 7/00; D04B 15/66

[52] U.S. Cl. ..... 66/75.2

[58] Field of Search ..... 66/75.1, 75.2, 231, 66/232

[56] References Cited

U.S. PATENT DOCUMENTS

| | | | |
|---|---|---|---|
| 3,693,377 | 9/1972 | Hadam | 66/75.2 |
| 3,699,782 | 10/1972 | Hadam | 66/75.1 |
| 3,715,897 | 2/1973 | Hadam | 66/75.2 |
| 3,892,108 | 7/1975 | Hadam | 66/75.2 |
| 3,955,381 | 5/1976 | Panchaud | 66/75.1 |
| 4,100,767 | 7/1978 | Schieber et al. | 66/75.2 |

*Primary Examiner*—Ronald Feldbaum

[57] ABSTRACT

In a flat knitting machine wherein needle jacks are longitudinally movably disposed in needle tricks, behind needles, the butts of the needle jacks being depressible into a needle bed, and wherein there are provided in the needle tricks, behind and above the needle jacks, selector jacks adapted to be selectively moved forwardly and backwardly by electromechanical needle selector means provided on a carriage, the improvement including means acting on the needle jacks to depress the butts thereof into the needle bed, said means comprising pushers disposed longitudinally movably in the needle tricks, behind the butts of the needle jacks and between the selector jacks, disposed above the pushers, and the needle jacks, disposed below the pushers, the front portion of the pushers being pivotally movable, the pushers being selectively controlled, for forward and backward movement, by the cooperative action of the selector jacks and cam means provided on the carriage, the pushers being adapted to depress the needle jacks only when they are selected by certain other cam means on the carriage for such action.

10 Claims, 16 Drawing Figures

FIG. 8-a
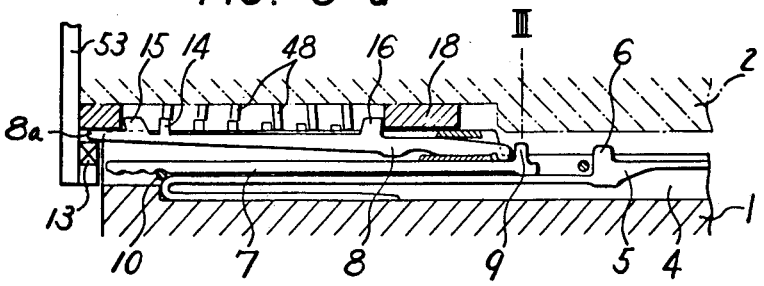
FIG. 8-b
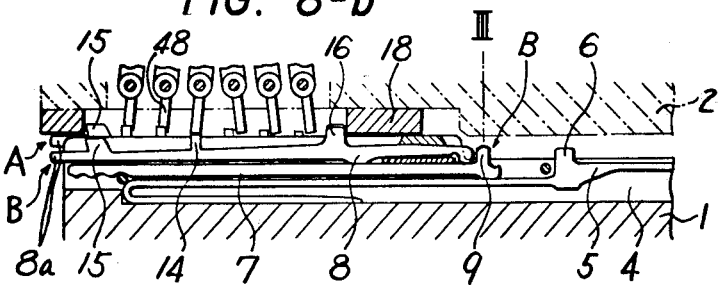
FIG. 8-c
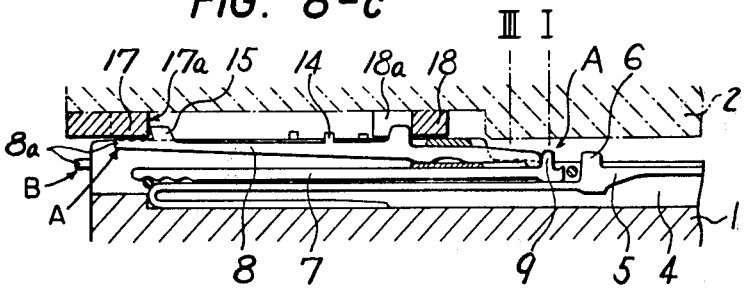
FIG. 8-d
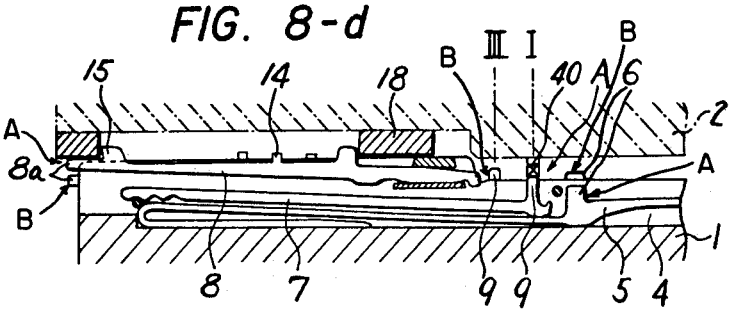

FIG. 8-e
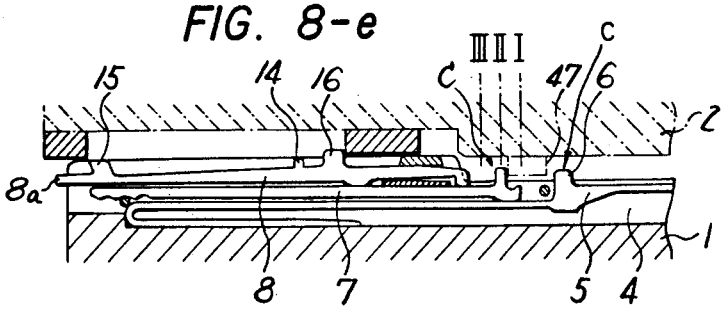
FIG. 8-f
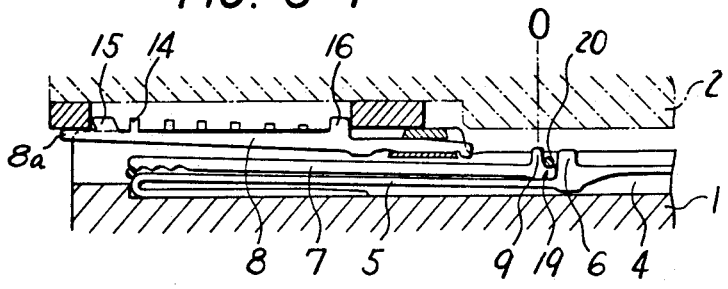

FLAT KNITTING MACHINE

BACKGROUND OF THE INVENTION

This invention relates to a flat knitting machine having electromechanically controlled needle selector means.

Several kinds of flat knitting machines are already known which are provided with a needle selector system controlled by electromechanical control means for the purpose of knitting as programmed in accordance with the required color design or knitting pattern. In these flat knitting machines, neddle jacks are pivotally and longitudinally movably disposed, behind the needles, in the needle tricks in which the needles are displaceably housed, and the needle jacks can be selectively moved forward or pivotally displaced or bent by the medium of electromechanically controlled needle selector means provided on the carriage; the butts of only the jacks so selected are caused to project into the operative zone of the knitting locks provided on the carriage, and thereupon the needles in front of the selected jacks are caused to knit or tuck by the action of the jacks and knitting locks acting on the butts of the jacks.

These prior art knitting machines which incorporate electromechanically controlled needle selector means for selective movement or projection of jack butts into the operative zone of the knitting locks are broadly classified into two types. One type is such that for individual jacks or for individual subjacks disposed behind the jacks in the needle tricks, there are provided, on the needle bed side, solenoids which act as needle jack selectors, and the butts of only the needle jacks selected by the solenoids are projected or displaced into the operative zone of the knitting locks. (Among the knitting machines of this type are those disclosed in West German Pat. Nos. 1635968 and 22224, Swiss Pat. No. 466487, and Japanese Pat. Publication No. 1582 of 1972.) The other type is such that selector jacks having individual selector butts thereon at individually different positions are longitudinally movably disposed in the needle tricks and behind the needle jacks and there are provided on the carriage electromechanically controlled needle selector means acting or the selector butts, whereby the selector jacks are selectively actuated to move foward so that the butts of the needle jacks thereby selected are urged to project or move forward into the operative zone of the knitting locks. (Knitting machines of this second type are dischlosed, by way of example, in West German Pat. Nos. 2010973 and 2315334, Swiss Pat. No. 460232, and Japanese Pat. Publication Nos. 30623 of 1977 and 14343 of 1977.)

The present invention relates to the improvement of a flat knitting machine having needle selector means of the latter mentioned type.

In any prior art flat knitting machine having a needle selector system of the latter type, when the selector jacks selected by the needle selector means are moved forward or displaced into an operative position, the needle jacks thereby selected (group A) are brought into the operative zone of the knitting locks on the carriage and those unselected (group B) are kept outside the operative zone of the knitting locks. In this case, the needle jacks of group A are allowed to perform knitting operation by the action of the knitting locks, but group B needle jacks can not be caused to participate in knitting operation by the action of the knitting locks without passing through further selection process.

For example, in order to knit a jacquard pattern fabric, with a prior art machine, it is necessary to carry out needle selection by electromechanical selector means on the carriage, from course to course. Upon completion of the first course knitting of face pattern, it is necessary to carry out selector jack control again, or otherwise the second course knitting of back pattern can not be performed.

SUMMARY OF THE INVENTION

It is the primary object of this invention to provide a flat knittingmachine which permits knitting operation in such a way that when selection is made by electromechanical means on the carriage and accordingly selected ones of the selector jacks in the needle tricks are moved forward or displaced into operative position, the needle jacks are sorted into two groups of A and B, and once the needle jacks are so grouped, needle jacks of desired group or groups (A or B, or A+B) are selected by the cam means on the carriage and brought into the operative zone of the knitting locks on the carriage without further selection process, so that needles of desired groups or groups (A or B, or A+B) may be put into knitting operation.

In order to eliminate the above described difficulty, the flat knitting machine in accordance with this invention incorporates the following improvement: in a flat knitting machine wherein needle jacks are longitudinally movably disposed in needle tricks and behind needles, the butts of the needle jacks are depressible into the tricked needle bed, and selector jacks adapted to be selectively moved back and forth by electromechanical needle selector means on the carriage are disposed in the needle tricks, behind and at a higher level than the needle jacks, the improvement comprising means acting on said needle jacks to depress the butts thereof into the needle tricks, which means comprise pushers provided longitudinally movably in the needle tricks, behind the butts of the needle jacks and between the needle jacks and the selector jacks, each of said pushers having its front portion disposed pivotally movably in the needle trick and having a butt on the top of said front portion and a surface adapted to depress the needle jack, at the underside of said front portion, means acting on the pushers to depress, through the pushers, the butts of the needle jacks into the needle bed, which means comprise retractable pusher cams provided on the carriage to exert depressing force upon the top of the butts of the pushers, means for moving foward the pushers, which means comprise said selector jacks disposed longitudinally movably in the needle tricks, behind the butts of the pushers and above the pushers, and means for moving back the pushers, which means comprise retractable cams provided on the carriage.

BRIEF DESCRIPTION OF THE DRAWINGS

Other objects and aspects of the invention will become apparent from the following description of embodiments with reference to the accompanying drawings in which:

FIGS. 8-*a*–8-*f* are partially cutaway views in section of a needle bed, showing the various positions of a selector jack and a pusher respectively in a needle trick.

DESCRIPTION OF PREFERRED EMBODIMENTS

A knitting machine according to this invention has a pair of needle beds 1, front and back, which are arranged in a substantially inverted V-shape fashion, and a pair of carriages 2 which traverse to and fro above and along the needle beds 1, as generally seen in the ordinary type of flat knitting machine. The front needle bed 1 and the back needle bed 1 incorporate same novelty devices according to this invention. Similarly, the front carriage 2 and the back carriage 2 include identical novelty device in accordance with the invention. Accordinly, the description hereinbelow relates to the front needle bed 1 and the front carriage 2.

Figure 1:
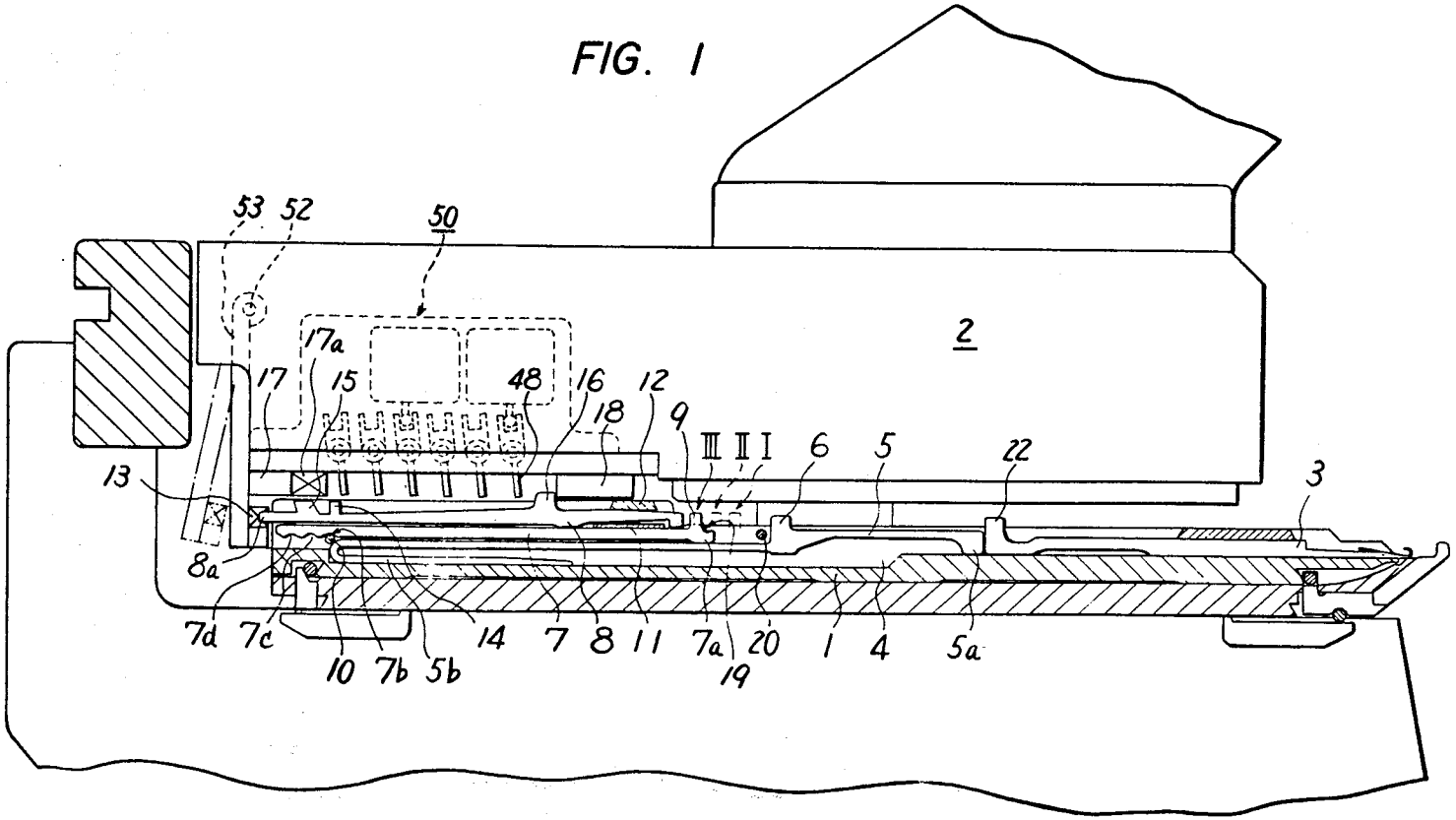
FIG. 1 is a side view in longitudinal section of a needle bed provided with a pusher according to this invention.

Referring now to the accompanying drawings, in FIG. 1, there is shown a needle bed 1 provided with needle tricks 4 in each of which a knitting needle 3 is longitudinally movably accommodated (only one of the tricks 4 being visible in FIG. 1). From its portion in which needle 3 is received, each needle trick 4 extends further backwardly to accommodate a needle jack 5 longitudinally movably behind the needle 3, said extension of needle trick 4 having a sufficient depth to allow butt 6 of the needle jack 5 to be depressed into the needle bed 1. The needle jack 5 so housed in the needle trick 4 is of resiliently flexible construction and has a tail end portion 5*b* of hairpin shape and a front end portion, both of which portions rest on the bottom of the trick 4. When depressed at its middle portion, the needle jack 5 bends (see FIG. 8*d*) so that butt 6 thereof, which normally remains protruded from the needle bed 1, is caused to sink into the needle bed.

The needle trick 4 has a fufficient depth to receive therein a pusher 7 and a selector jack 8 (both to be hereinafter deseribed) movably, both longitudinally and pivotally, above needle jack 5 and behind butt 6 thereof.

The pusher 7, disposed above the needle jack 5 in each needle trick 4, has a butt 9 provided thereon adjacent its front end. The pusher 7 has a knob-like projection 7*a* formed at the underside of the front end portion thereof, which projection 7*a* abuts the upper surface of needle jack 5 adjacent the jack butt 6, and three recesses 7*b*, 7*c*, 7*d* formed at the underside of the rear end portion thereof, one of which recesses lightly engages a click stopper 10 of piano wire which passes through the needle trick 4 deep into the needle bed 1, so that the pusher 7 is longitudinally movable in the trick 4 and its front portion is pivotally movable about the click stopper 10 which serves as a fulcrum.

Above the pusher 7 in each needle trick 4, there is provided a selector jack 8 which exerts a pushing force upon the pusher 7 when the front end thereof strikes the back of the butt 9 of the pusher 7, said selector jack 8 being longitudinally movable, with some part of its front portion held lightly between metal straps 11 and 12 on the needle bed 1, and pivotally movable at its rear portion.

Said pusher 7, when butt 9 thereof is selectively depressed by cam means (hereinafter to be described) provided on carriage 2, is pivotally displaced, as illustrated in FIG. 8-*d*, to depress the needle jack 5, thus urging the butt 6 of the needle jack 5 to sink into the needle bed 1.

In the flat knitting machine of this invention, the butts 9 of the pushers 7 are selectively moved into not less than two positions in the longitudinal direction of the pushers 7 by the cooperative action of the selector jacks 8, selected for forward movement by electromechanical selector means on the carriage, and cam means (pusher restoring cams 46 to be hereinafter described) provided also on the carriage 2. In the embodiment shown, it is arranged that the butts 9 of the pushers 7 are selectively caused to assume one of the three positions shown in FIG. 1, that is, forward position I, intermediate position II, rearward position III, in the longitudinal direction of the pushers 7 by the cooperative action of the selector jacks 8 and the cam means on the carriage (i.e., restoring cams 46 and half-restoring cams 47, both hereinafter to be described), each pusher 7 being held pivotally movably in the so selected position through a faint engagement of the aforementioned click stopper 10 in one of the recesses 7*b*, 7*c*, 7*d* formed at the underside of the rear end portion of the pusher 7.

As above described, each selector jack 8 is disposed longitudinally movably and, at its rear end portion, pevotally movably in the needle trick 4 so that, when selected by the control mechanism on the carriage, it can move forward to knock at its front end against the back of butt 9 of the pusher 7 to displace the pusher from rearward position III into forward position I. When the selector jack 8 is at its rearmost position, its rear end 8*a* protrudes rearwardly from the needle trick 4, and when a collector cam 13 on the carriage 2 is caused to act upon the rear end 8*a* of the selector jack 8, said rear end 8*a* is brought into a raised position as shown in FIG. 8*a* for preparation of needle selection.

Each selector jack 8 is provided at the upside of its pivotally movable free end portion with a selector butt 14 upon which a selector cam 48 (hereinafter to be described) of needle selector means 50 (hereinafter to be described) acts to displace it into a lowered position as shown in FIG. 1 only when the selector jack 8 at its elevated position (FIG. 8-*a*) is among those selected by selector cams 48 of the selector means 50. Each selector butt 14 is disposed on each respective selector jack 8 at one of several different positions suitably selected for each group of selector jacks. (See FIG. 5 and 6.) In the embodiment being described, there are provided 6 varieties of selector jacks 8 which have selector butts 14 individually disposed thereon at 6 different positions corresponding to the positions of 6 selector cams 48

(hereinafter to be described) respectively, and the selector jacks 8 of each variety having selector butts 14 disposed at same position are arranged in needle tricks 4 at 6-pitch intervals. When, during the travel of the carriage 2, selector cams 48 controlled by the electromechanical selector means 50 on the carriage are caused to act upon the selector butts 14 of the selected varieties of selector jacks 8, the selector jacks 8 of selected varieties only one lowered at free end portion thereof to their original position as shown in FIG. 1.

At a certain location on the free end portion of each selector jack 8 there is provided a raising butt 15, which permit a raising cam 17 provided on the carriage 17 to act thereupon during the run of the carriage and when the free end portion of the selector jack 8 is at its raised position, so that the selector jack 8 can be moved forward to push the pusher 7 forward from rearward position III to forward position I. Further at a suitable position on each selector jack 8 there is provided a restoring butt 16 which is adapted to be acted upon by restoring surface 18*a* of a guide cam 18 provided on the carriage 2, when the selector jack 8 has been brought into it forward position as above described, so that the selector jack 8 can be pushed back from the forward position until its rear end 8*a* is brought back to the original position thereof in the operative zone of the collector cam 13 on the carriage 2.

In the present embodiment, the pusher 7 is provided on its front end portion, in front of the butt 9, with a hooking recess 19 which is engageable, as illustrated in FIG. 8-*f*, with a stopper 20 which is disposed in the needle bed 1 and composed of a piano wire passing through the needle trick 4 at a suitable point, if the pusher 7 is manually forced down as it is pushed forward slightly beyond forward position I, so that the pusher 7 can be held at a zero position. When brought into the zero position, the pusher 7 is allowed to keep itself outside the operative zone of the selector jack 8 and has the butt 9 thereof depressed into the needle trick 4; and the pressing force exested by the pusher 7 on the needle jack 5 causes the butt 6 of the needle jack 5 to sink into the needle bed 1, the needle jack 5 being thus kept in idle position.

Figure 2:
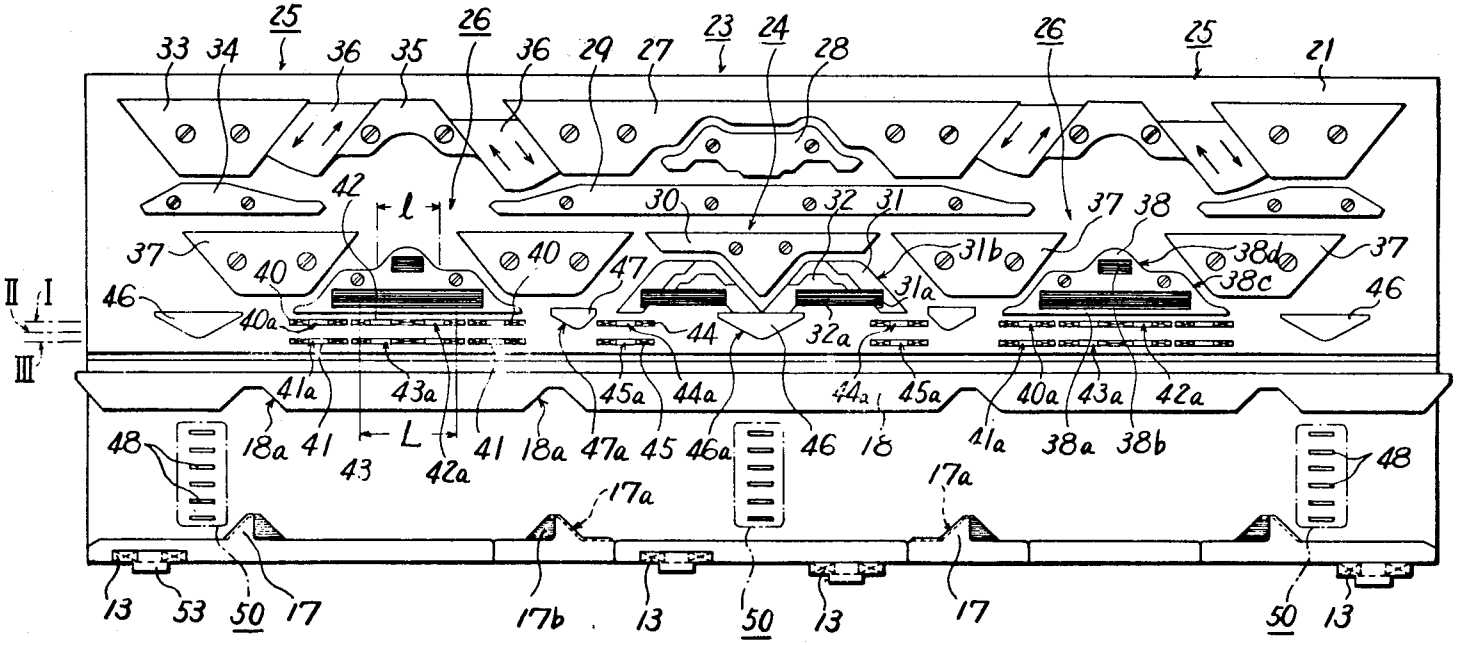
FIG. 2 is a plan view showing by way of example cam means for controlling pushers as provided on a carriage in face-to-face relation with a needle bed.

FIG. 2 shows cam means provided on the carriage 2. For a better understanding of the invention, a double lock system is shown in the drawing, but a single lock system may be used in any other embodiment. Also for facilitating understanding, in the drawing, concave inclined surfaces are indicated with horizontal lines drawn along the surface, and convex inclined surfaces with an X-ed line.

In the drawing, there are shown, on a cam plate 21 at center portion thereof, a transfer lock 23 acting on butts 22 of knitting needles 3 and a transfer lock 24 acting on butts 6 of needle jacks 5, the former lock at upper side and the latter lock at lower side; and on both sides of these transfer locks there are disposed knitting locks 25 acting on butts 22 of knitting needles 3 and knitting locks 26 acting on butts 6 of needle jacks 5, symmetrically respectively.

The transfer lock 23 consists of transfer guide cams 27, 28 and a guide cam 29, all of symmetrical configuration, fixed to the cam plate 21, and the transfer lock 24 consists of a jack guide cam 30 fixed to the cam plate 21 and a pair of retractable transfer reaise cams 31 and a pair of retractable acceptance raise cams 32, said pairs of cams 31 and 32 being symmetrical and having inclined surfaces 31*a* and 32*b* respectively.

The knitting lock 25 consists of guide cams 33, 34, 35, all fixed to the cam plate 21, and a pair of stitch cams 36 which are movement-controllable in the direction of the arrows along the cam plate 21. The knitting lock 26 acting on the butts 6 of the needle jacks 5 consists of a pair of guide cams 37 and a pair of raising cams 38, both symmetrically disposed and fixed to the cam plate 21. Each raising cam 38 is provided, on the passageway for the butts 6 of needle jacks 5 at rearmost position thereof and on the passageway for the butts 6 of needle jacks 5 moved into tucking position, with depressions 38*a* and 38*b* respectively, said depressions having bevelled surfaces at both ends and adapted to receive butts 6 of needle jacks 5, and accordingly the raising cam 38 has two raising surfaces formed thereon for the butts 6, namely, a raising surface 38*c* for tucking purpose and a raising surface 38*d* for knitting purpose, the length L of the bottome of said depression 38*a* in the direction of travel of the carriage is greater than the distance 1 in a straight line of the knitting-purpose raising surface 38*d* in the same direction.

Further, on the cam plate 21, below the knitting locks 26 and transfer lock 24 as in FIG. 2, there are provided lines of cams which exert a depressing force on the top of the butts 9 of the pushers 7 and lines of cams which exert a push-back force on the front surface of the butts 9, these lines of cams being retractable into the cam plate 21.

The former lines of cams exerting a depressing force on the butts 9 of the pushers 7 are disposed on trackways for such action on the top of those butts 9 which are in their forward position I or in thier rearmost position III during the travel of the carriage 2, and consist of 4 pairs of pusher cams 40,41 which, at most substantially projected working surface portions thereof, have flat surfaces 40*a*, 41*a* disposed so as to cover, in the direction of travel of the carriage 2, the operative zone at starting portion of the tucking-purpose raising surfaces 38*c* of the raising cams 38, and 4 pairs of pusher cams 42, 43 which, at most substantially projected working surface portions thereof, have flat surfaces 42*a*, 43*a* disposed so as to cover, in the direction of travel of the carriage 2, the operative zone at starting portion of the knitting purpose raising surfaces 38*d*, above the tucking position, of the raising cam 38, and 2 pairs of pusher cams 44, 45 which, at most substntially projected working surface portions thereof, have flat surfaces 44*a*, 45*a* disposed so as to cover, in the direction of travel of the carriage 2, the operative zone at starting portion of the raising surfaces 31*b* of the transfer raise cams 31, said pusher cams 40, 41, 42, 43, 44, 45 being slanted on both sides.

The latter mentioned lines of cams, all retractable, which exert push-back force on the front surface of the butts 9 of the pushers 7, consist of three pusher restoring cams 46 having a cam surface 46*a* adapted to act on the butts 9 of the pushers 7 during the travel of the carriage 2, when the pushers 7 are either in forward position I or in intermediate position II, so that the pushers 7 will return to rearward position III, and two pusher half-restoring cams 47 having a cam surface 47*a* adapted to act on the butts 9 of the pushers 7 during the travel of the carriage 2, only when the pushers 7 are in forward position I, so that the pushers 7 will retire to intermediate position II, said pusher restoring cams 46 being disposed at middle and both side positions on the cam plate 21, said pusher half-restoring cams 47 being disposed at middle position on the cam plate 21.

Figure 9:
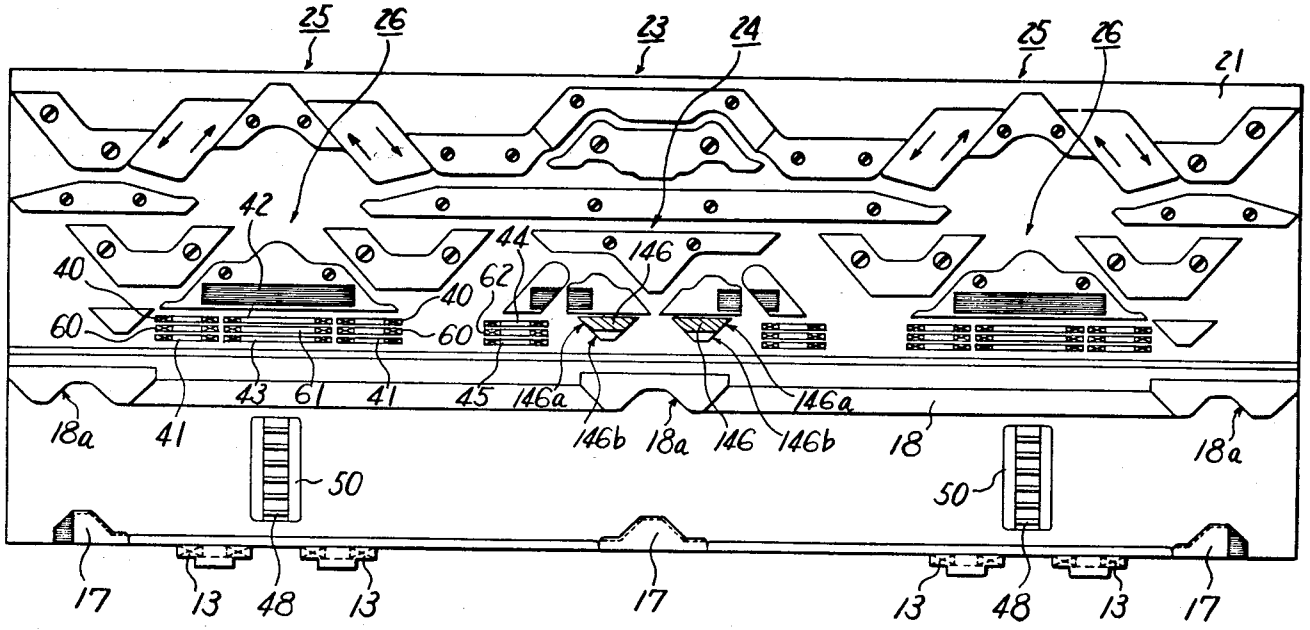
FIG. 9 is a plan view showing another form of cam means for pusher control as provided on a carriage in face-to-face relation with a needle bed.

In the present embodiment, the pusher half-restoring cams 47 are disposed between the pusher cams 40 and 44. Alternatively, it is possible that, as shown in FIG. 9, in the middle portion of the cam plate 21, two pusher restoring cams 146, both retractable, are provided which have two-level operative positions, upper and lower and are projection level controllable so that at their fully projected state, the restoring cams 146 have working surfaces 146*a* and 146*b* projected on the cam plate 21, which surfaces act on the pusher butts 9 in either forward position I or intermediate position II to cause them to return to rearward position III, as is the case with the pusher restoring cams 46 in FIG. 2, while in the half-projected state of the restoring cams 146, the working surface 146*b* which is adapted to actuate the pusher butts 9 in intermediate position II to return to reward position III is not seen on the cam plate 21 and there remains projected on the cam plate 21 only the working suface 146*a* adapted to actuate the pusher butt 9 in forward position I to move back to intermediate position II. In FIG. 9, upper operating portion of said pusher restoring cams 146 is indicated with oblique lines.

Next, electromechanical selector means 50, including cam means, will be described which are provided on the carriage 2 for controlling the movement of selected ones of the selector jacks 8 during the travel of the carriage 2.

On the carriage 2 there are provided three sets of electromechanical selector means, each set of which is disposed below one of the three pusher restoring cams 46 in FIG. 2 and consists of a number of selector cams 48 adapted to act on the top of the selector butts 14 of selected ones of the selector jacks 8, whose respective free end portions have been elevated, by the action of the collector cams, from their rearmost position in the needle tricks 4, for depressing the selected selector jacks 8 to their lowered position, combined with a number of solenoids 49 which actuate the selector cams 48 individually in accordance with specific electrical signals.

Figure 5:
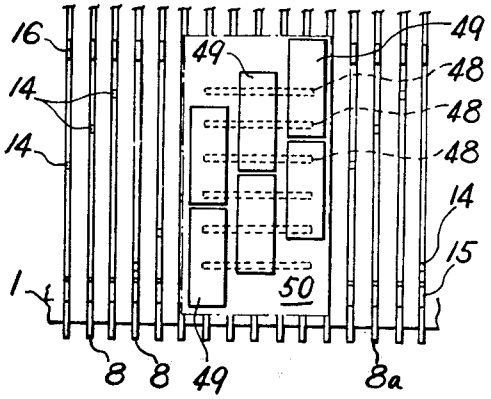
FIG. 5 is a plan view thereof.
Figure 6:
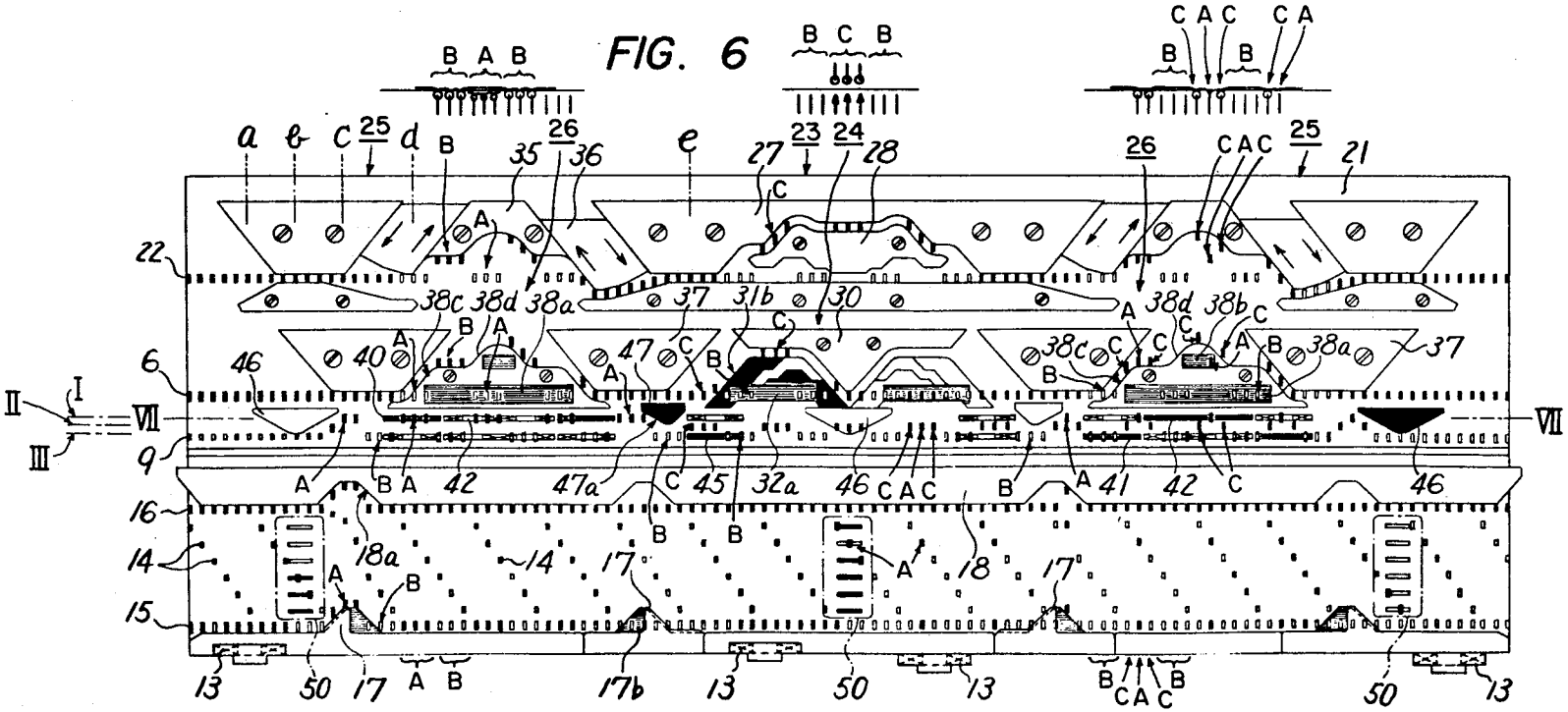
FIG. 6 is a schematic view illustrating the operation of the cam means shown in FIG. 2, with indications, on a drawing identical with FIG. 2, as to positions of individual butts during a phase of knitting operation. Corresponding needle operating pattern of the cams is shown above the plan view.

In the present embodiment, the selector jacks 8 have selector butts individually disposed thereon at 6 different positions selected stepwise in lengthwise direction and are arranged in such a way that, as will be seen from FIGS. 5 and 6, selector jacks 8 having selector butts 14 disposed thereon at same position in lengthwise direction are present in the needle tricks at 6-pitch interwals. The electromechanical selector means 50 composed of a combination of 6 selector cams 48 and 6 solenoids 49 are disposed on the carriage 2 at each of above said three positions so that the selector cams 48 will selectively act on the selector butts 14 at said three positions.

Figure 4:
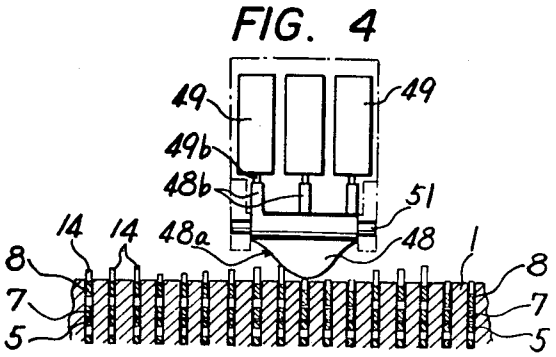
FIG. 4 is a front view thereof.
Figure 3:
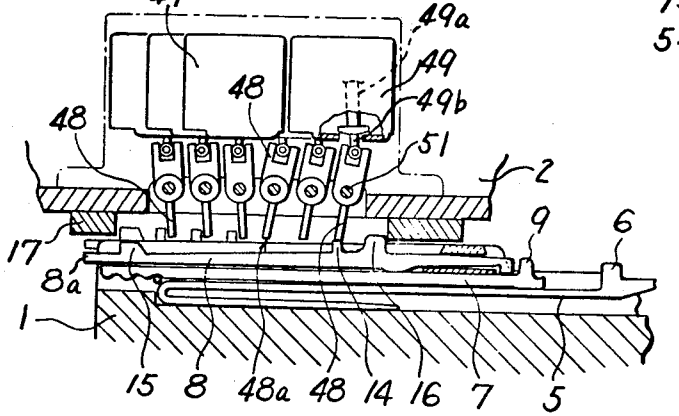
FIG. 3 is a side view illustrating schematically a needle selector system provided on a carriage.

Details of the electromechanical selector means 50 are shown in FIGS. 3–5. Each individual selector cam 48 is pivotally movably supported at 51 on the carriage 2 and has a working surface 48*a* acting on the selector butts 14, and a fork-shaped arm portion 48*b* disposed opposite the working surface 48*a* and associated with an insulator 49*b* at the tip and of a movable core 49*a* of one of the solenoids 49. When the solenoid 49 is energized by electric current flowing in a specified direction, the selector cam 48 connected to the solenoid is caused to tilt to the right (see FIG. 3) and retain itself in the operative zone relative to selector butts 14, and when the solenoid 49 is energized by electric current flowing in the opposite direction, the selector cam 48 is caused to tilt to the left (see FIG. 3) and retain itself in the inoperative zone relative to selector butts 14.

As will be seen from the above description, in order to have selected ones of the selector butts 14 depressed, it is necessary that prior to selection by the selector cams 48 of the selector means 50, the free end portions of all the selector jacks 8 should be raised to the operative zone of the selector jacks 8. For this purpose, on the carriage 2, immediately before the selector means 50 in the direction of travel of the carriage 2, there are provided collector cams (preparation cams) 13 adapted to act, during the travel of the carriage 2, upon the underside of rear end portion 8*a* of the selector jacks 8 for elevation of said rear end portion 8*a*. Each collector cam 13 is mounted to the front end portion of an arm 53 pivotally supported suitably at 52 on the carriage 2. When the arm 53 is controlled by certain control means (not shown), the collector cam 13 will be, selectively positioned at either an operative position shown by a continuous line or an inoperative position shown by a one alternate long and short dash line (in FIG. 1).

Further, on the carriage there are provided raising cams 17 adapted to act upon the raising butts 15 of the selector jacks 8, selectively retained in their raised position by the selector means 50, to cause the selector jacks 8 to move forward, each said raising cam 17 being fixedly mounted on the carriage, opposite the collector cam 13 with the selector means 50 between in the direction of travel of the carriage 2.

The raising cams 17 have a surface 17*a* which serves for raising purpose only in one direction facing the selector means and also an inclined surface 17*b* which exerts depression on the top of the raising butts 15 in the other direction.

As described earlier, when the selector jack 8 is pushed forward by the action of the raising cam 17, its front end pushes the pusher 7 to displace the latter from rearward position III to forward position I. After this is done, the selector jack 8 should be promptly moved back from its forward position to prepare for next selection work. For this purpose, on the carriage 2, at a suitable position involving some phase lag relative to the raising-purposed surface 17*a* of the raising cam 17, there is provided a guide cam 18 having a working surface 18*a* which exerts a pushing back force on the restoring butt 16 of the selector jack 8.

In the flat knitting machine according to this invention as above described, the selection of needles 3 is carried out through the control from the carriage side in the following manner, and it is possible to obtain smooth and effecient operation of the selected needles, either knitting or tucking as programmed.

Figure 7:
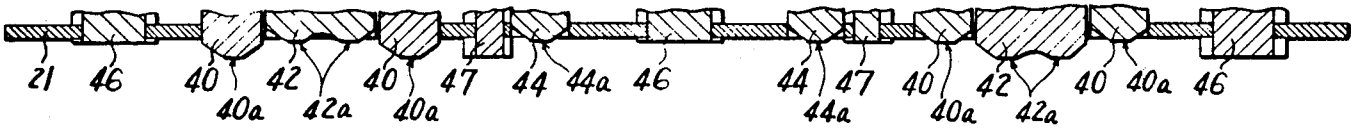
FIG. 7 is a sectional view taken substantially along the line VII—VII of FIG. 6.

The manner of needle selection operation of a flat knitting machine of the form described in connection with FIGS. 1–5 will now be explained with reference to FIGS. 6–8. FIG. 6 illustrates needle selection being made by the left selector means 50 and the central selector means 50 in the course of travel from right to left of the cam plate 21 of the carriage 50.

In this course of run, two needle-selector means 50 are employed for needle selection, and accordingly two collector cams 13 in front thereof in the direction of travel of the carriage are already controlled to position. In the left side selector means 50, three selector cams 48, the 4th, 5th and 6th cams counting from the top, are controlled to position for action on selector butts 14, and in the center selector means 50, one selector cam 47, 2nd from the top, is also controlled to position for action on selector butts 14. Retractable cam means on the carriage 2 (cams 31, 32, cams 40–47) are seen projected into position for action on butts 6,9. (Said cam means are shown smeared out in FIG. 6.)

As the carriage 2 with controlled arrangement as above said runs along this course from right to left, the collector cams 13 act on the rear end portion 8*a* of the selector jacks 8, and all the selector jacks 8 have their free end portions displaced into an elevated position as shown in FIG. 8-*a* and thus selector butts 14 thereof are brought into the operative position of the selector cams 48 for preparation for needle selection.

When the selector cams 48 of the left side needle selector means 50 act on selector butts 14 so positioned, the free end portions of individual selector jacks 8 on which the selector cams 48 have acted are lowered to the position of FIG. 8-*b*. The selector jacks 8 are now separated into two groups (A and B), and accordingly the needle jacks 5 are separated into two groups (A and B) and then the needles are also separated into two groups (A,B).

For convenience's sake, the group of selector jacks 8 retained in elevated position is called group A, and the lowered group of selector jacks 8 is called group B. The selector jacks 8 of group A are moved forward when the raising cams 17 act on the raising butts 15 of the selector jacks (FIG. 8-*c*), while the selector jacks of group B on which the raising cams 17 do not act, remain in their rearward position.

Accordingly, only the pushers 7 (group A) throust by the selector jacks 8 of group A have their butts 9 throusted from rearward position III to forward position I, and the pushres of group B remain in rearward position III.

Subsequently, the selector jacks 8 of group A are brought back to reqrward position by the action of the restoring surfaces 18*a* of the guide cams 18. However, the butts 9 of group A pushers are retained in their forward position I (on the control trackway of cams 40,42,46,47), and the butts 9 of group B pushers 7 are kept in their rearward position III (on the control trackway of cams 41, 43, 45).

The needles 3 and needle jacks 5 selected into two groups of A and B in such manner enter the operative zone of the left side knitting locks 25,26. In this zone, the pusher cams 40 are controlled in their operative position and accordingly the pushers 7 of group A have their butts depressed by the pusher cams 40 and are pivotally displaced. (FIG. 8-*d*) Thereupon, the needle jacks 5 of group A, depressed by the pushers 7, become bent and the butts thereof are caused to sink into the needle tricks 4 to which the action of the raising cams 38 do not extend. Thus, the butts 6 of group A needle jacks 5 passes through depressions 38*a*, not entering the knitting path.

Whilst, the pushers 7 of group B are not depressed by the pusher cams 41 and therefore retain the butts 6 of the needle jacks 5 of group B in the projection position on which the raising cams 38 can act. Accordingly, the needle jacks 5 of group B are then put in knitting path by the action of the raising cams.

Hence, in the operative zone of the left side knitting locks 25, 26, the needles 3 of group A miss and the needles 3 of group B knit.

It is needless to say that if, on the contrary, pusher cam 40 is set for retreated position and pusher cam 41 for prjected position, group A needles 3 knit and group B needles miss. If both pusher cams 40,41 are set for retreated position, both group A and group B needles 3 will knit. Likewise, if both pusher cams 40, 41 are set for projected position, both group A and group B needles will miss.

Thus, selected by the left hand needle selector means 50 and controlled by the cam means (pusher cams 40, 41) on the carriage, both group A and group B pushers 7 pass through the operative zone of the knitting locks 25, 26. Then, group A pushers 7 held in forward position I are subjected to the action of pusher half-restoring cam 47 which is positioned in projected position, and the butts 9 of group A pushers 9 are urged to retreat to intermediate position II. For convenience's sake the pushers 7 so caused to retreat and the needle jacks 5 and needles 3 below the pushers 7 are referred to as group C. Now, the entire combination of needles 3, needle jacks 5 and pushers 7 is separated into two groups, B and C. The needs 3 and needle jacks 5 of both groups B and C then enter the operative zone of the transfer locks 23, 24.

In the operative zone of the transfer locks 23, 24, the pushers of group B are depressed, on the top of the butts 9 thereof, by pusher cam 45, which is positioned in projected position, being subjected to pivotal displacement. The butts 6 of group B needle jack 5 are depressed into the needle tricks 4 by the action of pusher cam 45 and pushers 7 as the working surface 31*b* of transfer raising cam 31 passes, and therefore pass inclined surfaces 31*a*, 32*a* and do not enter the transfer path.

Whilst, group C pushers 7 retain the butts 6 of needle jacks 5 in projected position at which transfer raise cam 31 can act upon the needle jacks 5, because no puhser cam is present then which acts upon group C pushers. Accordingly, group C needle jacks 5 are put on the transfer path by the action of transfer raise cam 31. Simultaneously, corresponding needle jacks 5 on the opposite side needle bed 1 are put on the operating path of transfer acceptance cam 32.

The presence of said pusher half-restoring cam 47 between the two needle selector means 50 permits any desired pushers 7, from among those separated into two groups C and B, at intermediate position II and rearward position II respectively, to be selected by the selector means 50 on the succeeding side (center selector means in this case) for displacement into forward position I.

In FIG. 6, after the free end portions of all the selector jacks 8 are displaced into elevated position by the collector cam 13 in front of the center selector means 50 for needle selection preparation, one selector jack 8, the second from the top, is selected by the center selector means 50 so as to be retained in elevated position. By the action of the so selected selector jack 8 are selected pushers 7 from among group C pushers, and the pushers 7 so selected are moved into forward position I to form a new group A.

The needles 3 and needle jacks 5 thus selected into three groups of A,B and C then enter the operative zone of the knitting locks 25, 26 on the right side.

In this operative zone, pusher cams 41, 42 are controlled to projected position, and needle jacks 5 of group B are depressed into the needle tricks in the operative zone of raising cam 38 and both group A and C jacks 8 are put on the operating path of raising cam 38. However, group A needle jacks 5 which are subject to the action of pusher cam 42 have their butts 6 depressed into the needle tricks 4 after being subjected to the action of raising surface 38*c*, up to tucking position, of raising cam 38 and before reaching the knitting-purpose raising surface 38*d* of the raising cam 38. Only the needle jacks 5 of group C only, pushers 7 of which group are not subject to the action of the pusher cams 41, 42, go through the action of raising cam 38 and are moved forward to knitting position.

Thus, in the operative position of the knitting locks 25, 26 on the right side, needles of group B miss operating opportunity and needles of group A tuck and needles 3 of group C knit.

If, on the contrary, pusher cams 40,43 are controlled to projected position, needles 3 of group A miss, needles 3 of group B tuck and needles 3 of group C knit.

In the above described embodiment, series of pusher cams 40,42,44 and 41, 43, 45 are provided on the cam plate 21, on the control trackway for the butts 9 of pushers 7 in forward position I and on the control trackway for the butts 9 of pushers 7 in rearward position III respectively. As shown in FIG. 9, however, if retractable pusher cams 60,61, 62 are provided on the cam plate 21, on the trackway for the butts 9 of pushers 7 in intermediate position II as well, the needles selected into two (A,B) or three (A,B,C) groups can be selectively actuated to knit, tuck or miss by selecting any one of the individual groups (A,B or C) or any desired combination of said groups (A+B, or B+C, or C+A, or A+B+C) through retruction or projection control of pusher cams 40–45 and 60–62, without further needle selection by needle selector means 50.

FIG. 9 shows another embodiment relating to the arrangement of cam means and needle selector means on the carriage 2. Needle selector means 50 and cams 40–46 may suitably be arranged as illustrated in FIG. 9. In the cam means of FIG. 9, members of same function as those in the cam means of FIG. 2 are shown with same reference numbers as in FIG. 2.

Figure 10:
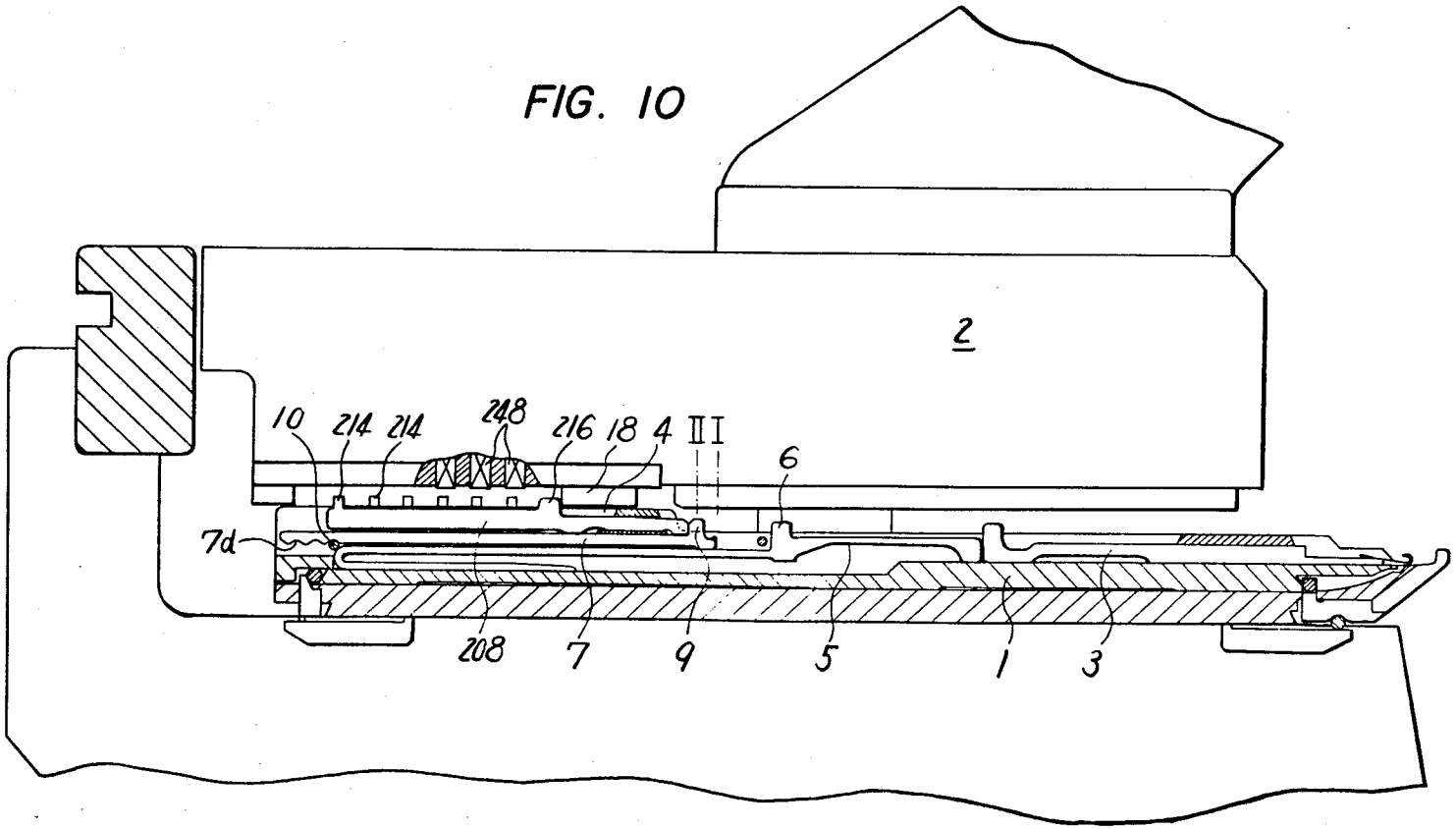
FIG. 10 is a side view in longitudinal section of a needle bed showing another form of selector jack.
Figure 11:
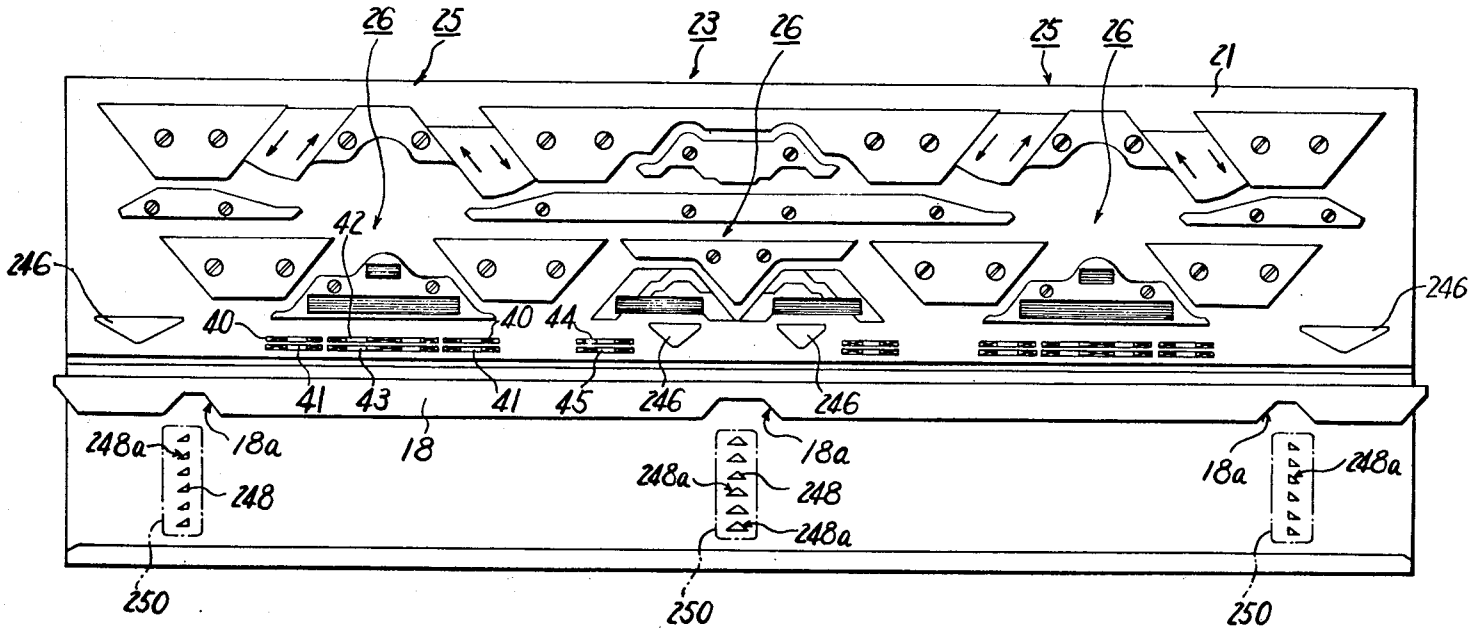
FIG. 11 is a plan view showing an example of cam means provided, on a carriage in face-to-face relation with a needle bed, for controlling selector jacks and pushers as illustrated in FIG. 10.

In the flat knitting machine of this invention, means for moving forward pushers 7 can be modified as described hereinbelow. FIGS. 10 and 11 show an example of such modification. This selector jack 208 has at suitable locations thereon a selector butt 214 and a restoring butt 216. The selector butt 214, as is the case with said selector butt 14, has varying projecting position in the lonitudinal direction of the selector jack. The selector jack 208 has no raising butt and is longitudinally movable in the needle trick 4, above the pusher 7.

Needle selector means 250, cam means (guide cams 218) and pusher restoring cams 246 provided on the carriage, all acting on such selector jacks 208, selector butts 214 and restoring butts 216 to move them selectively are arranged as illustrated in FIGS. 10 and 11. In FIGS. 10 and 11, members of same function as earlier described are shown with identical reference numbers.

In the selector means 250 shown in FIGS. 10 and 11, selector cams 248 consist of retractable cams having a cam surface 248*a* which, at projected position, exerts a thrust direct on selector butts 214. Each selector cam 248 is controlled by a self-retaining type solenoid (not shown) for retraction into and projection from the cam plate, and each solenoid is controlled by electromagnetic pattern signals.

The operation of the flat knitting machine of the form shown in FIGS. 10 and 11 will now be explained. In this flat knitting machine, the selector jacks 208 are thrust by selector cam 248 which selectively acts on the butts of the selector jacks and when the jacks 208 are moved forward, the pushers 7 thereby selected are brought into forward position.

When all the pushers 7 are selected into those in forward position and those in rearward position, the selector jacks 208 are restored to their original position by the restoring surface 18*a* of guide cam 18, which surface acts on the restoring butts 216, to prepare for next selection.

As is clearly seen from the above deseription of the preferred embodiments, in a flat knitting machine to which this invention relates, there are disposed in the needle tricks, behind and above the needle jacks, selector jacks which are selectively longitudinally moved forward and backward by electromechanical needle selector means on the carriage: through the control of the needle selector means according to electromagnetic pattern signals, the selector jacks are selectively moved forward and the butts of the needle jacks thereby selected are depressed into the needle tricks to remain outside the operative zone of the knitting locks on the carriage. However, the flat knitting machine accorting to this invention incorporate improved means which act on the needle jacks to cause the butts thereof to sink into the needle tricks. Unlike the prior art machines in which the selector jack itself or a member associated direct (at least in the longitudinal direction) with the selector jack is employed for that purpose, the knitting machine of this invention has pushers provided in the needle tricks, behind the butts of the needle jacks and between the needle jacks and the selector jacks, said pushers being longitudinary movable, and at its front portion, pivotally movable in the needle tricks. When the pushers are selectively depressed into the needle tricks by cam means, on the carriage, acting on the butts (on the front free end portion) of the pushers, the pushers so depressed, in turn, act on the needle jacks therebelow, through the underside of their front portion, to depress the butts of the needle jacks into the needle tricks. In the flat knitting machine of this invention, means for controlling the positions of individual pushers in the needle tricks include selector jacks which are selectively moved forward and backward by the electromechnical needle selector means on the carriage, and pusher restoring cams and/or pusher half-restoring cams, provided on the carriage. Accordingly, needle selection operation by the selector jacks are very simple: needles, needle jacks and pushers on the needle bed are divided into two or three combined groups, and individual pusher butts are selectively positioned in one of two positions, forward and rearward, or of three positions, forward, intermediate and rearward. When the needles, needle jacks and pushers are so divided into groups as to their positions, which group of needles are to knit or tuck or miss is readily determined by selecting any particular knitting locks in whose operative zone the pusher cams having surfaces to exert pressure on pusher butts are to operate nd any particular group or groups on whose pusher butts the pusher cams are to act.

To explain more concretely, in the flat knitting machine of this invention, once the positions of individual pushers are determined as above grouped by the cooperative action of the needle selector means on the carriage and the selector jacks on the needle bed, the state of needle selection as grouped into two or three groups by the needle selector means is electromechanically filed in the memory of the pushers, and accordingly, if the selector jacks are caused to return to a position ready for a next needle selection or if the needle jacks are displaced by the action of the knitting locks on the carriage, the state of needle selection still remains in the memory of the pushers. For example, in the case of knitting such a jacquard pattern consisting of face and back patterns as earlier mentioned, knitting of any course, whether face pattern or back pattern, can be easily performed in accordance with the state of needle selection in the memory of the pushers and through the control by the pusher cams acting on the pushers, without further selection of selector jacks by the electromechanical needle selector means. When a double lock system is employed, knitting of first and second courses, face and back patterns, can be performed in one course operation.

What is claimed is:

1. A flat knitting machine having needle jacks which are longitudinally movably disposed in the needle tricks, behind needles, the butts of said needle jacks being depressible into the tricked needle bed, wherein the improvement comprises: selector jacks disposed in the needle tricks, behind and at a higher level than the needle jacks and adapted to be selectively moved back and forth by electromechanical needle selector means on the carriage, means acting on said needle jacks to depress the butts thereof into the needle tricks, which means comprise pushers provided longitudinally movably in the needle tricks, behind the butts of the needle jacks and between the needle jacks and the selector jacks, each of said pushers having its front portion disposed pivotally movably in the needle trick and having a butt on the top of said front portion thereof and a surface adapted to depress the needle jack at the underside of said front portion, means acting on the pushers to depress, through the pushers, the butts of the needle jacks into the needle bed, which means comprise retractable pusher cams provided on the carriage to exert depressing force upon the top of said pusher butts, means for moving forward the pushers from their rearward position to their forward position, which means comprise said selector jacks disposed longitudinally movably in the needle tricks, behind the pusher butts and above the pushers, and having their front end adapted to strike the back of the pushers as the selector jacks move forward, means for moving back the pushers from their forward position into which the pushers have been moved by the selector jacks, which means comprise retractable cams provided on the carriage, said retractable cams including pusher restoring cams adapted to move the pushers back from their forward position to their rearward position and pusher half-restoring cams adapted to move back the pushers from said forward position to intermediate position.

2. The flat knitting machine as set forth in claim 1, wherein said selector jacks are disposed pivotally movably at either front or rear portion thereof in the needle trick and have selector butts disposed individually at suitable locations on said pivotally movable portion thereof and also have raising butts and restoring butts at fixed locations respectively on said pivotally movable portion thereof, and wherein there are provided, on the carriage, means for selectively moving forward said selector jacks, comprising collector cams acting on the pivotally movable end portions of the selector jacks to move upward said pivotally movable end portions and which are displaceable from operative position to inoperative position and vice versa, selector cams which, controlled by said electromechanical needle selector means, act on the top of said selector butts to urge them downward and which are individually displaceable from operative position to inoperative position and vice versa, raising cams acting on the back of said raising butts, and means for moving rearward said selector jacks, comprising guide cams acting on the front surface of said restoring butts.

3. The flat knitting machine as set forth in claim 2, wherein said selector jacks have their respective rear potions disposed pivotally movably in the needle tricks and wherein said collector cams are arranged so as for them to exert a pullup force to the underside of the selector jacks at rear end portion thereof.

4. The flat knitting machine as set forth in claim 1, wherein said selector jacks have selector butts at suitable locations thereon and restoring butts at a fixed location thereon, and wherein there are provided, on the carriage, means for selectively moving forward said selector jacks, comprising selector cams which, controlled by said electromechanical needle selector means, act on the back of said selector butts to urge them forward and which are individually displaceable from operative position to inoperative position and vice versa, and means for moving rearward said selector jacks, comprising guide cams acting on the front surface of said restoring butts.

5. The flat knitting machine as set forth in claim 1, wherein said retractable cams pusher half restoring provided on the carriage as means for moving back said pushers are pusher restoring cams having two-level operative positions, upper and lower, and which are projection level controllable, and wherein each of said pusher restoring cams, at its fully projected state, has working surfaces projected which act on pusher butts in either forward position or intermediate position to move them back to rearward position and, at its half-projected state, has a working surface projected which acts on pusher butts in forward position only to move them back to intermediate position.

6. The flat knitting machine as set forth in claim 1, wherein said pusher cams are disposed in two lines, one on the control trackway for the butts of the pushers in their forward position and the other on the control trackway for the butts of the pushers in their rearward position.

7. The flat knitting machine as set forth in claim 1, wherein said pusher cams are disposed in three lines, a first one on the control trackway for the butts of the pushers in their forward position, a second one on the control trackway for the butts of the pushers in their intermediate position and a third one on the control trackway for the butts of the pushers in their rearward position.

8. The flat knitting machine as set forth in claim 1, wherein each of said pushers disposed longitudinally movably in the needle tricks is held clickstopwise in the needle trick through a faint engagement of a click stopper made of piano wire, which extends through the trick into the needle bed, in one of a pluarlity of recesses formed at the rear end portion of the pusher, at the underside thereof, and wherein the pusher, at its rear end portion, is pivotally movable about said click stopper which serves as a fulcrum.

9. The flat knitting machine, as set forth in claim 1, wherein a hooking recess is formed on the top of front end of each pusher and at a suitable location in the needle trick there is provided a stopper which passes through the trick into the needle bed, so that the butt of the pusher and the butt of the needle jack may be caused to sink into the needle trick by putting said hooking recess in engagement with said stopper.

10. The flat knitting machine as set forth in inclusive, claim 1, wherein said knitting locks on the carriage include a transfer lock provided between a pair of knitting locks.

* * * * *